US009601255B2

(12) United States Patent
Kubota et al.

(10) Patent No.: US 9,601,255 B2
(45) Date of Patent: Mar. 21, 2017

(54) AMORPHOUS CORE TRANSFORMER

(75) Inventors: Keisuke Kubota, Tainai (JP); Toshiki Shirahata, Shibata (JP); Junji Ono, Shibata (JP); Yoetsu Shiina, Tainai (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 310 days.

(21) Appl. No.: 13/569,229

(22) Filed: Aug. 8, 2012

(65) Prior Publication Data

US 2013/0106555 A1 May 2, 2013

(30) Foreign Application Priority Data

Nov. 1, 2011 (JP) ..... 2011-239840

(51) Int. Cl.
*H01F 27/24* (2006.01)
*H01F 27/25* (2006.01)
*H01F 41/02* (2006.01)

(52) U.S. Cl.
CPC ..... *H01F 27/25* (2013.01); *H01F 41/0226* (2013.01)

(58) Field of Classification Search
CPC ..... H01F 27/25; H01F 41/0226
USPC ..... 336/212
See application file for complete search history.

(56) References Cited

U.S. PATENT DOCUMENTS 3,183,461 A * 5/1965 Tipton ..... 336/60
6,005,468 A * 12/1999 Shirahata et al. ..... 336/212
2001/0033216 A1 10/2001 Shirahata et al.

FOREIGN PATENT DOCUMENTS

JP 2005-129966 A 5/2005

* cited by examiner

*Primary Examiner* — Elvin G Enad
*Assistant Examiner* — Ronald Hinson
(74) *Attorney, Agent, or Firm* — Crowell & Moring LLP

(57) ABSTRACT

In an amorphous core transformer, an amorphous core is constructed such that, when a plurality of kinds of amorphous magnetic strips having different widths are arranged in abutting relation and laminated, the amorphous magnetic strips are alternated in arrangement for lamination so that abutting surfaces of the arranged and laminated amorphous magnetic strips are displaced with respect to one another. Thus, hours of wrapping work are drastically reduced and working efficiency is improved.

4 Claims, 11 Drawing Sheets

AMORPHOUS CORE TRANSFORMER

CLAIM OF PRIORITY

The present application claims priority from Japanese Patent Application JP 2011-239840 filed on Nov. 1, 2011, the content of which is hereby incorporated by reference into this application.

BACKGROUND

The present invention relates to an amorphous core transformer, and more particularly, to an amorphous core transformer having a wound core (hereinafter referred to as the amorphous core) using amorphous magnetic strips.

The amorphous magnetic strip used for the amorphous core transformer has a very small thickness ranging from 0.022 to 0.025 mm and has the property of being high in hardness and brittle. Furthermore, as the material of the amorphous magnetic strip, a material with an amorphous sheet wound in a roll shape is used, however, the properties vary.

Also, there is known an amorphous core transformer in which the amorphous magnetic strips are wound to form a wound core. For example, in an amorphous core transformer for three phase 1000 KVA having a three-phase five-legged core as shown in FIG. 8, wound cores 50*a* to 50*h* and coils 40*a* to 40*c* are housed within a transformer tank container.

As for the wound cores, the amorphous magnetic strips are wound to form a unit core of approximately 170 mm in width and approximately 16200 $mm^2$ in cross-sectional area. The unit cores are aligned in two rows widthwise of the strips, and four sets of unit cores, all eight pieces, are used.

An outer unit core located on each side has a core window with the coil of one phase disposed therein, while each of two inner unit cores has a core window with the coils of two phases disposed therein. Therefore, the masses of the inner unit cores and the outer unit cores are about 158 kg and about 142 kg, respectively, the inner unit cores being greater in mass and outer peripheral length than the outer unit cores.

A core coil assembly is composed of the eight unit cores 50*a* to 50*h* and the three coils 40*a* to 40*c*, as shown in FIG. 8. Each of the unit cores has a U-shaped cross-section so as to permit its insertion into the coils. After insertion, the ends are closed (subjected to wrapping operation), thereby assembling the core and the coil.

Within the coils 40*a* to 40*c*, there are installed bobbins 60*a* to 60*f*, two for each coil. As shown in FIG. 9, each of the unit cores 50*a* to 50*h* is opened on one side. The unit core of an inverted U-shape is inserted into the corresponding coil, and the opened portion is wrapped to assemble the core and the coil.

The coil bobbins are made of metal such as iron and formed in hollow square poles. As described above, two bobbins for each coil are arranged side by side.

Next, FIG. 10 shows a horizontal sectional view of the related art core coil assembly shown in FIG. 8.

Referring to FIG. 10, the coils of three phases are formed of the outer secondary coils 40*a*, 40*b*, and 40*c* and primary coils 40*d*, 40*e*, and 40*f*. The bobbins, with two bobbins for each coil arranged side by side, are installed in the coils. More specifically, the bobbins 60*a* and 60*b* are installed in the coils 40*a* and 40*d*, the bobbins 60*c* and 60*d* are installed in the coils 40*b* and 40*e*, and the bobbins 60*e* and 60*f* are installed in the coils 40*c* and 40*f*. Then the amorphous cores are inserted into the bobbins.

The core 50*a* is inserted into one side of the bobbin 60*a* installed in the coils 40*a* and 40*d* on the left side in FIG. 10, and the core 50*b* is inserted into one side of the bobbin 60*b*.

The cores 50*a* and 50*b* are inserted into one side of the bobbins 60*a* and 60*b*, respectively, in such a manner that the cores 50*a* and 50*b* of the inverted U-shapes straddle the left edges of the coils 40*a* and 40*d*. Then left portions of the cores 50*a* and 50*b* located outside of the coil 40*a* are received by an E-shaped clamp 70 so as to keep their assembled conditions, and thereafter held and fixed from above by a U-shaped clamp 80.

This construction on the left side is applied in the same manner to the cores 50*g* and 50*h* on the right side to fix the cores 50*g* and 50*h*.

The core 50*c* on the left-center lower side is inserted into the other side of the bobbin 60*a* and one side of the bobbin 60*c* installed in the coils 40*a* and 40*d* and the coils 40*b* and 40*e*, respectively, in such a manner as to straddle the portion where the coils 40*a* and 40*d* and the coils 40*b* and 40*e* are adjacent to each other. In the same manner, the core 50*d* on the left-center upper side is inserted into the other side of the bobbin 60*b* and one side of the bobbin 60*d* installed in the coils 40*a* and 40*d* and the coils 40*b* and 40*e*, respectively, in such a manner as to straddle the portion where the coils 40*a* and 40*d* and the coils 40*b* and 40*e* are adjacent to each other.

The core 50*e* on the right-center lower side is inserted into the other side of the bobbin 60*c* and one side of the bobbin 60*e* installed in the coils 40*b* and 40*e* and the coils 40*c* and 40*f*, respectively, in such a manner as to straddle the portion where the coils 40*b* and 40*e* and the coils 40*c* and 40*f* are adjacent to each other. In the same manner, the core 50*f* on the right-center upper side is inserted into the other side of the bobbin 60*d* and one side of the bobbin 60*f* installed in coils 40*b* and 40*e* and the coils 40*c* and 40*f*, respectively.

The core 50*g* on the right side is inserted into the other side of the bobbin 60*e* installed in the coils 40*c* and 40*f* and a portion of the E-shaped clamp 70 installed outside the coils 40*c* and 40*f*, in such a manner as to straddle the right edge portions of the coils 40*c* and 40*f*. Also, the core 50*h* is inserted into the other side of the bobbin 60*f* installed in the coils 40*c* and 40*f* and a portion of the E-shaped clamp 70 installed outside the coils 40*c* and 40*f*, in such a manner as to straddle the right edge portions of the coils 40*c* and 40*f*. The cores 50*g* and 50*h* received by the E-shaped clamp 70 are fixed from above by the U-shaped clamp 80.

Here, the related art core and bobbins are shown in FIGS. 11 and 12.

FIG. 11 shows the inverted U-shaped core 50*a* with one end of the unit core opened. In order to obtain more core cross-sectional area with the cores the same in width, two rows of the cores having the same width as described above are inserted into the two bobbins 60*a* and 60*b* arranged side by side as shown in FIG. 12 so as to compose the core coil assembly.

In the related art, in order to increase the core width and core cross-sectional area of the amorphous core transformer, the eight unit cores made of the amorphous magnetic strips having the same width are aligned in two rows as described above to compose the amorphous core transformer.

Unfortunately, this related art construction has been inefficient in operation because wrapping operations of eight cores for a single transformer are necessary to assemble the core coil assembly.

SUMMARY OF THE INVENTION

Accordingly, an object of the present invention is to provide an amorphous core transformer having an amorphous core construction with improved operating efficiency while obtaining more amorphous core cross-sectional area in the assembly operation of a core coil assembly of a large-capacity amorphous core transformer.

In order to achieve the above-mentioned object, according to an aspect of the present invention, an amorphous core transformer stores a core coil assembly. The core coil assembly includes: an amorphous core composed of amorphous magnetic strips; and a coil for allowing insertion of the amorphous core. In the amorphous core transformer, the amorphous core is constructed such that, when plural kinds of the amorphous magnetic strips having different widths are arranged in abutting relation and laminated, the amorphous magnetic strips are alternated in arrangement for lamination so that abutting surfaces of the arranged and laminated amorphous magnetic strips are displaced with respect to one another.

With existing amorphous wound cores, there is a need to perform the wrapping work twice. On the other hand, with the amorphous wound core according to the aspect of the present invention, the wrapping work can be carried out at one time, leading to an improvement in working efficiency. Also, in the related art, it is necessary to arrange the amorphous wound cores in two rows for each coil, and therefore the two bobbins are necessary. On the other hand, in the amorphous wound core according to the aspect of the present invention, a single bobbin per each coil is disposed. Thus, the need for partitions is eliminated, and therefore the bobbin and coil can be miniaturized.

DESCRIPTION OF THE PREFERRED EMBODIMENTS

Hereinafter, an amorphous core transformer according to embodiments of the present invention will be described with reference to the accompanying drawings.

Figure 1:
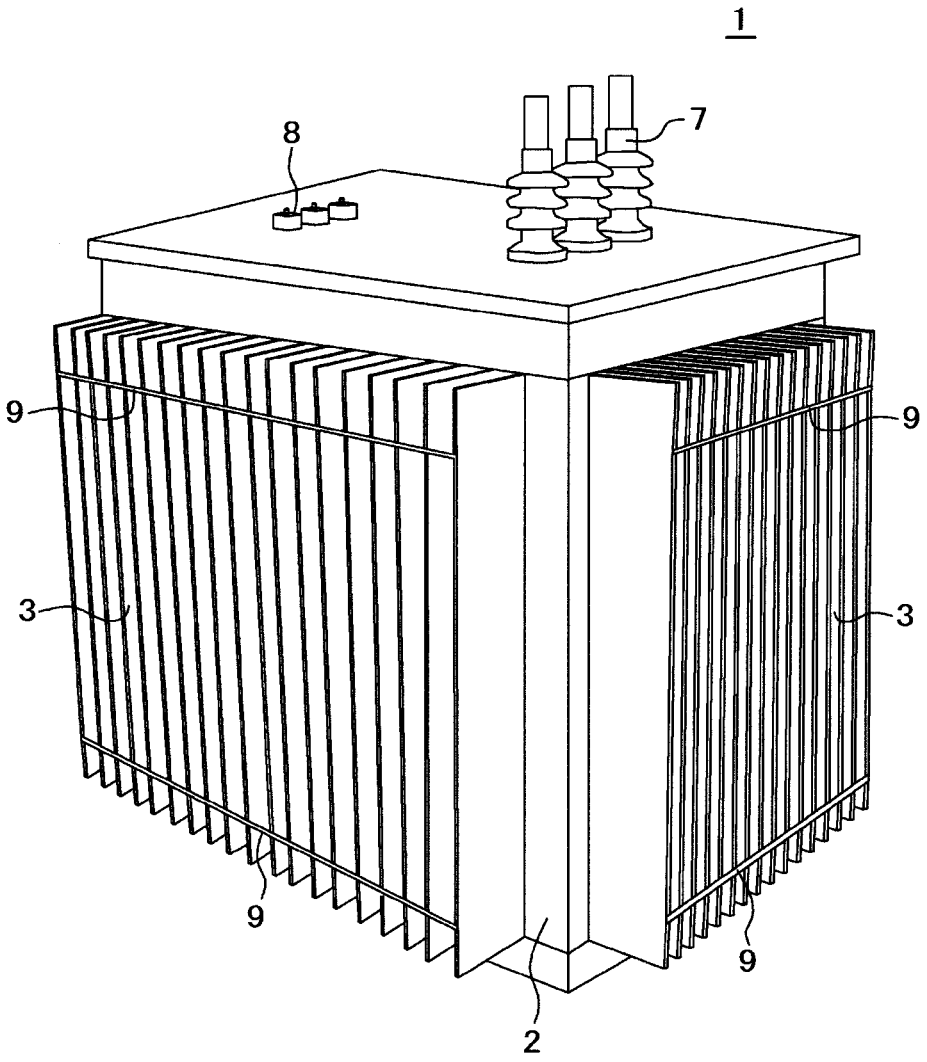
FIG. 1 is a perspective view of the external appearance of an amorphous core transformer according to a first embodiment of the present invention.

FIG. 1 is a perspective view showing the external appearance of an amorphous core transformer mounted with amorphous cores according to a first embodiment of the present invention.

Referring to FIG. 1, an amorphous core transformer 1 has a structure in which wavy ribs 3 are provided on peripheral edges of a tank container 2 that contains insulating oil for insulating and cooling the amorphous cores and coils attached to the amorphous cores, for cooling heat generated from the coils, the cores, etc.

Furthermore, in FIG. 1, reference sign 9 denotes weld lines that are welded and fixed to upper and lower portions of each of the wavy ribs 3 to produce the resistance of the wavy ribs 3 to deformation. Reference sign 7 denotes a primary terminal that is installed on an upper portion of the tank container 2 to connect high-voltage power transmitted from a power plant. Reference sign 8 denotes a secondary terminal that is installed on an upper portion of the tank container 2 to provide the connection for sending the voltage raised or reduced by the transformer to a load side.

Next, a core coil assembly according to this embodiment will be described with reference to FIG. 2.

Figure 2:
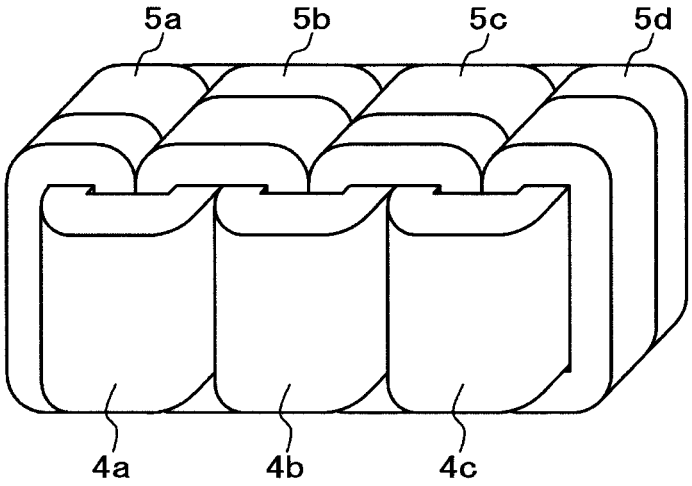
FIG. 2 is a perspective view of a core coil assembly according to the first embodiment of the present invention.

FIG. 2 is a perspective view showing the core coil assembly mounted with the amorphous cores and bobbins according to this embodiment.

Referring to FIG. 2, the amorphous core transformer 1 is a three-phase five-legged core transformer, and there is shown the state in which three coils (4*a*, 4*b*, and 4*c*) are installed, and amorphous cores 5*a*, 5*b*, 5*c*, and 5*d* are inserted into the coils 4*a*, 4*b*, and 4*c* and wrapped.

A line on a surface of each of the amorphous cores 5*a* to 5*d* is the abutment line between the amorphous magnetic strips that form each of the amorphous cores 5*a* to 5*d*. It should be noted that the magnetic strip abutment lines of two adjacent cores differ in position from each other for emphasizing the difference in core width, however, such alternation of the core surfaces as shown in FIG. 2 are not always necessary.

Next, the assembling process of the core coil assembly shown in FIG. 2 will be described with reference to FIG. 3.

Figure 3:
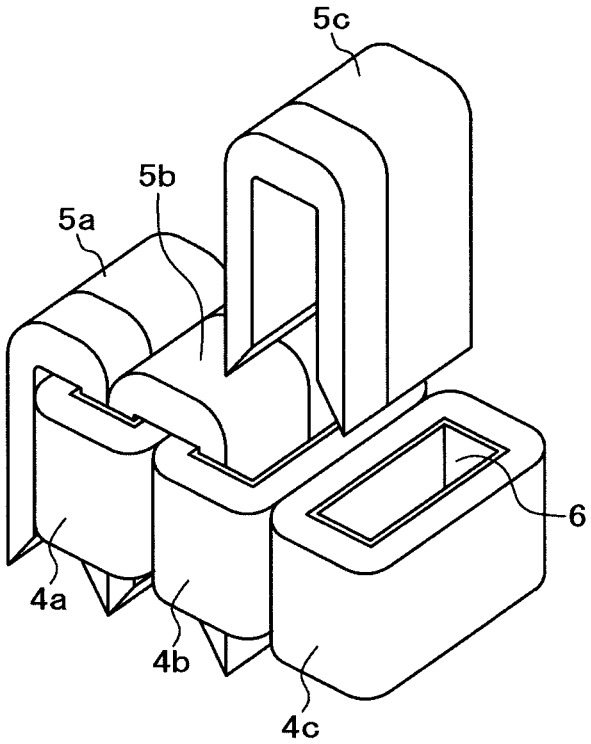
FIG. 3 is a perspective view showing assembling process of the core coil assembly according to the first embodiment of the present invention.

FIG. 3 shows the assembling process for assembling the cores and coils according to this embodiment, wherein reference signs 5*a* to 5*c* denote the amorphous cores; 4*a* to 4*c*, the coils; and 6, a bobbin installed in each coil.

FIG. 3 shows that the amorphous core 5*c* is in the process of being inserted into the coil 4*c* with the amorphous cores 5*a* and 5*b* disposed inside the coils 4*a* and 4*b*.

Also, referring to FIG. 3, each of the amorphous cores 5*a* to 5*c* is constructed by bringing the amorphous magnetic strips of different widths into abutting relation to each other and alternately laminating the magnetic strips of different widths. The details will be described later in FIG. 4.

Figure 9:
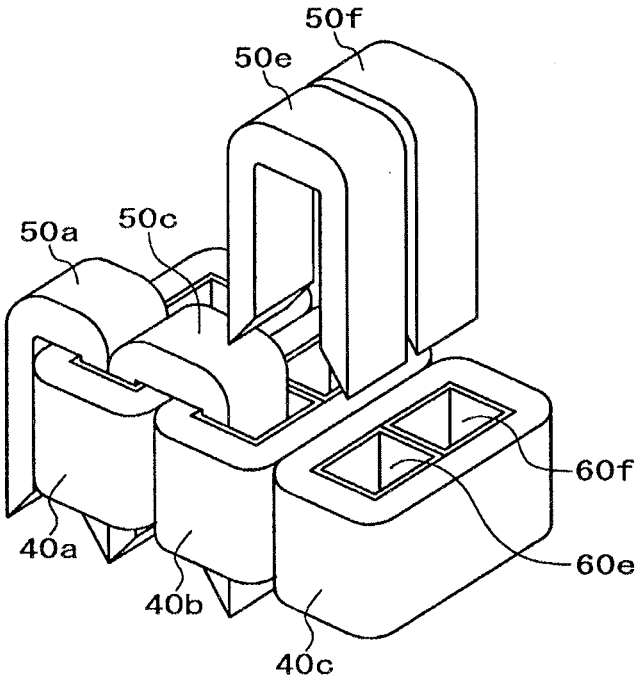
FIG. 9 Prior Art
FIG. 9 is a perspective view showing assembling process of the core coil assembly according to the related art.
Figure 10:
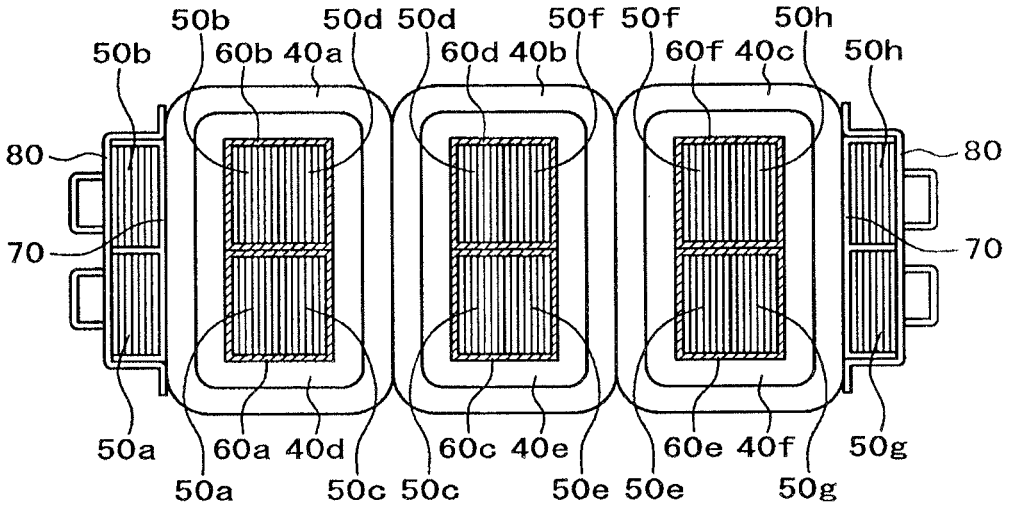
FIG.10 Prior Art
FIG. 10 is a horizontal sectional view of the related art core coil assembly shown in FIG. 8.
Figure 11:
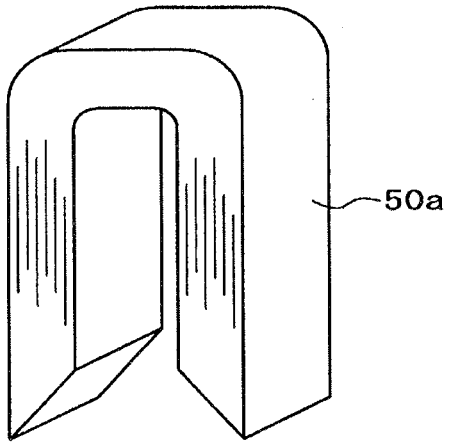
FIG.11 Prior Art
FIG. 11 is a perspective view of a unit core according to the related art.

The core of this embodiment has a construction in which the two magnetic strips having different widths are integral with each other, unlike the related art construction as shown in FIG. 9 in which the magnetic strips having the same width are arranged in two rows.

In this manner, by forming the amorphous core of an integrated combination of the amorphous magnetic strips, it is possible to construct the core in a single row, rather than two rows according to the related art.

Therefore, the wrapping work of open ends of the amorphous cores 5*a* to 5*d* after inserting the amorphous cores 5*a* to 5*d* into the coils 4*a* to 4*c* can be cut in almost half relative to the related art.

In addition, the bobbins 6 installed in the coils 4*a* to 4*c* can be reduced from two bobbins per coil to a single bobbin per coil. Therefore, it is possible to reduce the cost of bobbin materials and downsize the bobbins while ensuring the cross-sectional area of the amorphous core. Consequently, the whole transformer can be downsized.

Next, the construction of the amorphous core 5*a* will be described with reference to FIG. 4.

Figure 4:
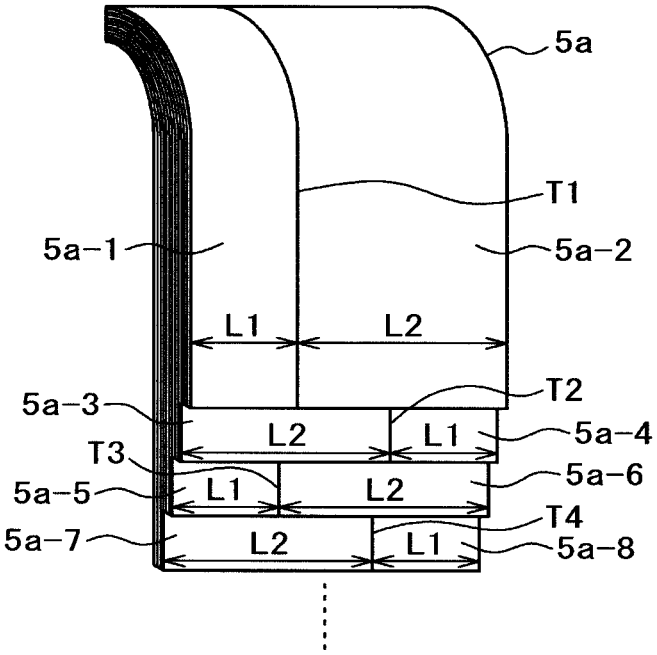
FIG. 4 is a partial perspective view showing the construction of an amorphous core according to the first embodiment of the present invention.

FIG. 4 is a perspective view of the state in which the amorphous cores are peeled away inwardly from the surface according to blocks.

As shown in FIG. 4, the amorphous core is formed by use of two kinds of blocks having different amorphous magnetic strip widths (namely, a small width L1 and a large width L2, the relationship of L1<L2 is established), and the laminated state thereof will be described in order, from a fourth layer counting inwardly from the surface.

Referring to FIG. 4, as for the amorphous cores of the blocks of the fourth layer counting inwardly from the surface, an amorphous core 5*a*-7 of the large width L2 on the left side and an amorphous core 5*a*-8 of the small width L1 on the right side are arranged in abutting relation and laminated to form the fourth layer.

Subsequently, an amorphous core 5*a*-5 of the small width L1 on the left side and an amorphous core 5*a*-6 of the large width L2 on the right side are arranged in abutting relation and laminated on the fourth layer to form a third layer counting inwardly from the surface.

Subsequently, an amorphous core 5*a*-3 of the large width L2 on the left side and an amorphous core 5*a*-4 of the small width L1 on the right side are arranged in abutting relation and laminated on the third layer to form a second layer counting inwardly from the surface.

Subsequently, an amorphous core 5*a*-1 of the small width L1 on the left side and an amorphous core 5*a*-2 of the large width L2 on the right side are arranged in abutting relation and laminated on the second layer to form a surface layer.

In this manner, in the amorphous core shown in FIG. 4, when comparing positions between an abutting surface T4 between the amorphous cores 5*a*-7 and 5*a*-8 of the fourth layer and an abutting surface T3 between the amorphous cores 5*a*-5 and 5*a*-6 of the third layer laminated on the fourth layer, they are displaced with respect to each other.

Also, when comparing positions between the abutting surface T3 between the amorphous cores 5*a*-5 and 5*a*-6 of the third layer and an abutting surface T2 between the amorphous cores 5*a*-3 and 5*a*-4 of the second layer laminated on the third layer, they are displaced with respect to each other.

Furthermore, when comparing positions between the abutting surface T2 between the amorphous cores 5*a*-3 and 5*a*-4 of the second layer and an abutting surface T1 between the amorphous cores 5*a*-1 and 5*a*-2 of the surface layer laminated on the second layer, they are displaced with respect to each other.

In this manner, the amorphous cores of the blocks having different widths of each layer abut against each other for lamination. Since the amorphous magnetic strips having different widths are alternately laminated, the abutting surfaces can be displaced with respect to one another. Therefore, the whole laminated cores can be integrated and regarded as a single-piece core.

Figure 5:
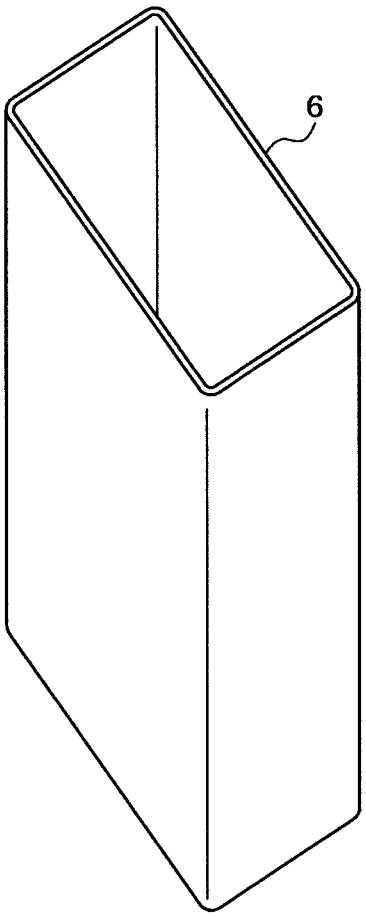
FIG. 5 is a perspective view of a bobbin installed in a coil according to the first embodiment of the present invention.

FIG. 5 is a perspective view of a bobbin installed in each coil.

Figure 12:
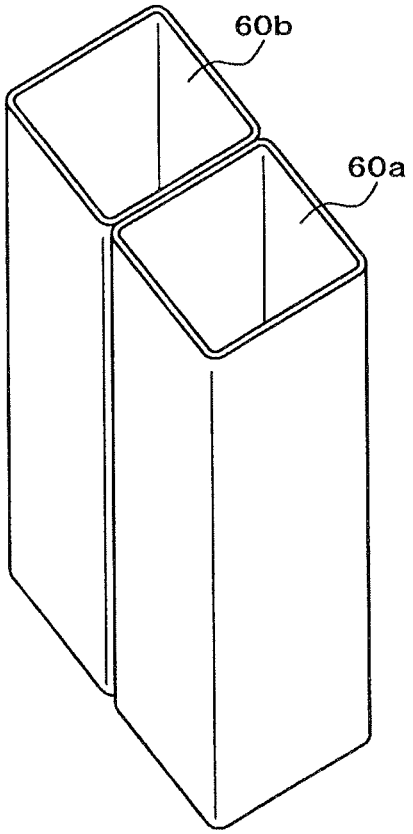
FIG.12 Prior Art
FIG. 12 is a perspective view of bobbins installed in a coil according to the related art.

The bobbin 6 of this embodiment, into which the amorphous core shown in FIG. 4 is inserted, has one insertion opening and is of a rectangular, hollow square pole shape. The bobbin 6 is made of metal material. In the related art, the two bobbins are arranged as shown in FIG. 12. On the other hand, in this embodiment of the present invention, the single bobbin is disposed. Thus, as described above, the need for partitions is eliminated, and therefore the cost of bobbin materials can be reduced. Also, it is possible to downsize the bobbins while ensuring the amorphous core cross-sectional area. Consequently, the whole transformer can be downsized.

Next, a second embodiment of the present invention will be described, in which an amorphous core is formed by using three amorphous magnetic strips so as to obtain more amorphous core width.

Here, as for the widths of the three amorphous magnetic strips, two magnetic strips have a large width L3 the same as each other and one magnetic strip has a small width L4. That is to say, the relationship of L4<L3 is established.

Figure 6A:
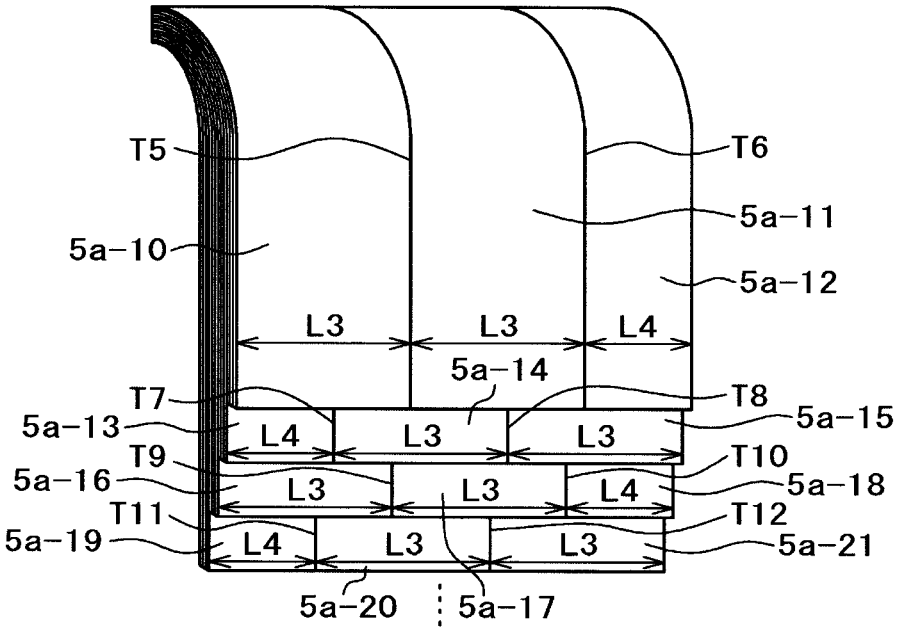
FIG. 6A is a partial perspective view showing the construction of an amorphous core according to a second embodiment of the present invention.

FIG. 6A is a perspective view of the state in which the amorphous core composed of two amorphous magnetic strips having the large width L3 the same as each other and one amorphous magnetic strip having the small width L4 is peeled away inwardly from its surface according to blocks.

Referring to FIG. 6A, the amorphous core, from a fourth layer counting inwardly from its surface, will be described.

Firstly, as for the fourth layer counting inwardly from the surface, an amorphous core 5*a*-19 of the small width L4 on the left side and an amorphous core 5*a*-20 of the large width L3 in the center abut against each other, and the amorphous core 5*a*-20 of the large width L3 in the center and an amorphous core 5*a*-21 of the large width L3 on the right side abut against each other to form the fourth layer.

Subsequently, the amorphous core of the small width L4 on the left side is moved to the right side. Then with an amorphous core 5*a*-16 of the large width L3 on the left side and an amorphous core 5*a*-17 of the large width L3 in the center abutting against each other, and the amorphous core 5*a*-17 of the large width L3 in the center and an amorphous core 5*a*-18 of the small width L4 on the right side abutting against each other, they are laminated on the fourth layer to form a third layer counting inwardly from the surface.

Subsequently, the amorphous core of the small width L4 on the right side is moved to the left side. Then with an amorphous core 5*a*-13 of the small width L4 on the left side and an amorphous core 5*a*-14 of the large width L3 in the center abutting against each other, and the amorphous core 5*a*-14 of the large width L3 in the center and an amorphous core 5*a*-15 of the large width L3 on the right side abutting against each other, they are laminated on the third layer to form a second layer counting inwardly from the surface.

Subsequently, the amorphous core of the small width L4 on the left side is moved to the right side. Then with an amorphous core 5*a*-10 of the large width L3 on the left side and an amorphous core 5*a*-11 of the large width L3 in the center abutting against each other, and the amorphous core 5*a*-11 of the large width L3 in the center and an amorphous core 5*a*-12 of the small width L4 on the right side abutting against each other, they are laminated on the second layer to form a surface layer.

Referring to FIG. 6A, abutting surfaces among three amorphous magnetic strips of each layer will be described.

When comparing an abutting surface T11 between the amorphous cores 5*a*-19 and 5*a*-20 and an abutting surface T12 between the amorphous cores 5*a*-20 and 5*a*-21 of the fourth layer with an abutting surface T9 between the amorphous cores 5*a*-16 and 5*a*-17 and an abutting surface T10 between the amorphous cores 5*a*-17 and 5*a*-18 of the third layer laminated on the fourth layer, the abutting surfaces T11 and T9 are displaced with respect to each other, and the abutting surfaces T12 and T10 are also displaced with respect to each other.

Furthermore, when comparing the abutting surface T9 between the amorphous cores 5*a*-16 and 5*a*-17 and the abutting surface T10 between the amorphous cores 5*a*-17 and 5*a*-18 of the third layer with an abutting surface T7 between the amorphous cores 5*a*-13 and 5*a*-14 and an abutting surface T8 between the amorphous cores 5*a*-14 and 5*a*-15 of the second layer laminated on the third layer, the abutting surfaces T9 and T7 are displaced with respect to each other, and the abutting surfaces T10 and T8 are also displaced with respect to each other.

Moreover, when comparing the abutting surface T7 between the amorphous cores 5*a*-13 and 5*a*-14 and the abutting surface T8 between the amorphous cores 5*a*-14 and 5*a*-15 of the second layer with an abutting surface T5 between the amorphous cores 5*a*-10 and 5*a*-11 and an abutting surface T6 between the amorphous cores 5*a*-11 and 5*a*-12 of the surface layer laminated on the second layer, the abutting surfaces T7 and T5 are displaced with respect to each other, and the abutting surfaces T8 and T6 are also displaced with respect to each other.

Thus, as shown in FIG. 6A, using the three amorphous magnetic strips composed of two magnetic strips having the large width L3 the same as each other and one magnetic strip having the small width L4, the amorphous cores of the blocks having different widths of each layer abut against one another and are sequentially laminated. Also, the magnetic strips are disposed such that the abutting surfaces of adjacent magnetic strips in a lamination direction are displaced with respect to each other. Therefore, the whole laminated cores can be integrated and regarded as a single-piece core.

Next, a modification of the second embodiment of the present invention will be described with reference to FIG. 6B, in which, in the case of using three amorphous magnetic strips the same as those shown in FIG. 6A, the abutting surfaces of the magnetic strips cannot be displaced with respect to each other.

Firstly, as for a fourth layer counting inwardly from the surface, the amorphous core 5*a*-20 of the large width L3 on the left side and the amorphous core 5*a*-19 of the small width L4 in the center abut against each other, and further, the amorphous core 5*a*-19 of the small width L4 in the center and the amorphous core 5*a*-21 of the large width L3 on the right side abut against each other to form the core of the fourth layer.

Subsequently, the amorphous core of the small width L4 in the center is moved to the right side. Then with the amorphous core 5*a*-16 of the large width L3 on the left side and the amorphous core 5*a*-17 of the large width L3 in the center abutting against each other, and further, with the amorphous core 5*a*-17 of the large width L3 in the center and the amorphous core 5*a*-18 of the small width L4 on the right side abutting against each other, they are laminated on the fourth layer to form a third layer counting inwardly from the surface.

Subsequently, the amorphous core of the small width L4 on the right side is moved to the left side. Then with the amorphous core 5*a*-13 of the small width L4 on the left side and the amorphous core 5*a*-14 of the large width L3 in the center abutting against each other, and further, with the amorphous core 5*a*-14 of the large width L3 in the center and the amorphous core 5*a*-15 of the large width L3 on the right side abutting against each other, they are laminated on the third layer to form a second layer counting inwardly from the surface.

Subsequently, the amorphous core of the small width L4 on the left side is moved to the center. Then with the amorphous core 5*a*-10 of the large width L3 on the left side and the amorphous core 5*a*-12 of the small width L4 in the center abutting against each other, and further, with the amorphous core 5*a*-12 of the small width L4 in the center and the amorphous core 5*a*-11 of the large width L3 on the right side abutting against each other, they are laminated on the second layer to form a surface layer.

Referring to the amorphous core of FIG. 6B, abutting surfaces among three amorphous magnetic strips of each layer will be described.

When comparing an abutting surface T19 between the amorphous cores 5*a*-20 and 5*a*-19 and an abutting surface T20 between the amorphous cores 5*a*-19 and 5*a*-21 of the fourth layer with an abutting surface T17 between the amorphous cores 5*a*-16 and 5*a*-17 and an abutting surface T18 between the amorphous cores 5*a*-17 and 5*a*-18 of the third layer laminated on the fourth layer, the abutting surfaces T17 and T19 are aligned in the same position, and the abutting surfaces T18 and T20 are displaced with respect to each other.

Furthermore, when comparing the abutting surface T17 between the amorphous cores 5*a*-16 and 5*a*-17 and the abutting surface T18 between the amorphous cores 5*a*-17 and 5*a*-18 of the third layer with an abutting surface T15 between the amorphous cores 5*a*-13 and 5*a*-14 and an abutting surface T16 between the amorphous cores 5*a*-14 and 5*a*-15 of the second layer laminated on the third layer, the abutting surfaces T15 and T17 are displaced with respect to each other, and the abutting surfaces T16 and T18 are also displaced with respect to each other.

Moreover, when comparing the abutting surface T15 between the amorphous cores 5*a*-13 and 5*a*-14 and the abutting surface T16 between the amorphous cores 5*a*-14 and 5*a*-15 of the second layer with an abutting surface T13 between the amorphous cores 5*a*-10 and 5*a*-12 and an abutting surface T14 between the amorphous cores 5*a*-12 and 5*a*-11 of the surface layer, the abutting surfaces T13 and T15 are displaced with respect to each other, while the abutting surfaces T14 and T16 are aligned in the same position.

Figure 6B:
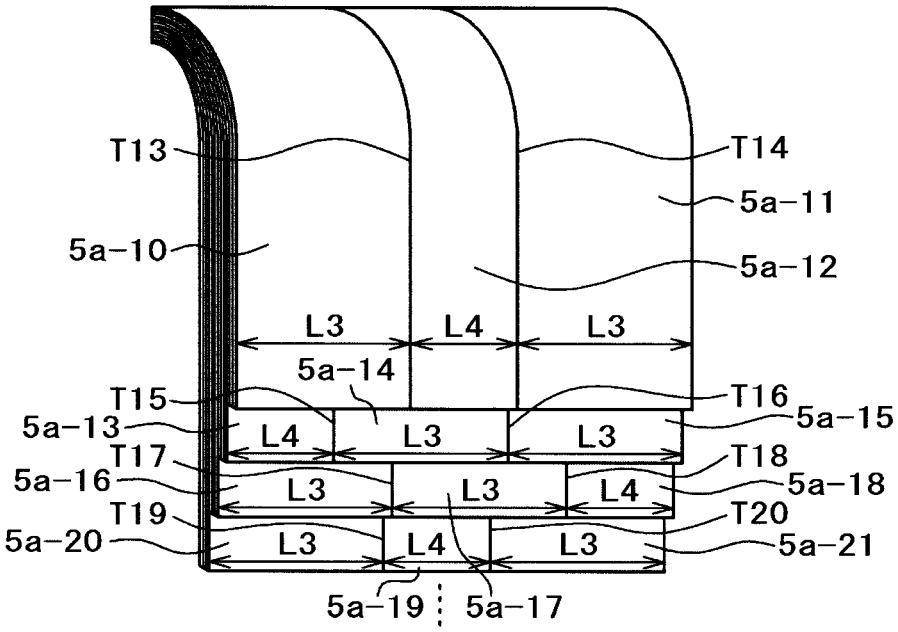
FIG. 6B is a partial perspective view showing a modification of the construction of the amorphous core of FIG. 6A.

In other words, in FIG. 6B, in some arrangements of the adjacent magnetic strips in the lamination direction, the abutting surfaces are aligned in the same position.

In such a state, if the amorphous cores are integrated, wrapping cannot be performed.

Figure 6C:
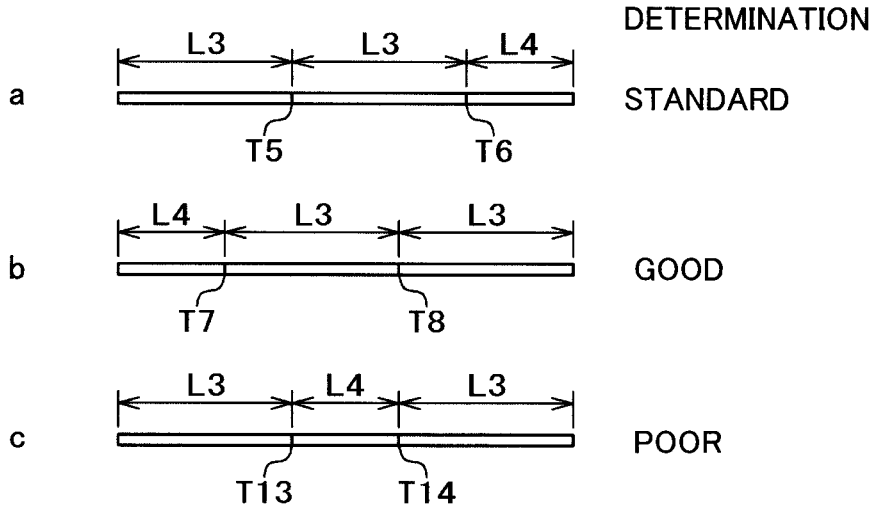
FIG. 6C illustrates constructions with amorphous magnetic strips of different widths laminated in abutting relation according to the second embodiment of the present invention.

FIGS. 6A and 6B are summarized in FIG. 6C.

FIG. 6C shows magnetic strip layout patterns in the case where an amorphous core is constructed using three magnetic strips (two magnetic strips of the large width L3 of the same size and one magnetic strip of the small width L4).

In FIG. 6C, (a) shows a standard layout pattern in which a magnetic strip of the large width L3 disposed on the left side and a magnetic strip of the large width L3 disposed in the center abut against each other, and further, the magnetic strip of the large width L3 disposed in the center and a magnetic strip of the small width L4 disposed on the right side abut against each other.

With reference to the layout (a), layout patterns of the three magnetic strips include two patterns of layouts (b) and (c).

The layout (b) shows a layout pattern in which a magnetic strip of the small width L4 disposed on the left side and a magnetic strip of the large width L3 disposed in the center abut against each other, and further, the magnetic strip of the large width L3 disposed in the center and a magnetic strip of the large width L3 disposed on the right side abut against each other.

In addition, the layout (c) shows a layout pattern in which a magnetic strip of the large width L3 disposed on the left side and a magnetic strip of the small width L4 disposed in the center abut against each other, and further, the magnetic strip of the small width L4 in the center and a magnetic strip of the large width L3 on the right side abut against each other.

When comparing the abutting surfaces of two adjacent magnetic strip arrangements in the lamination direction with reference to the layout (a) of FIG. 6C, the abutting surfaces T7 or T8 of the layout (b) are displaced and misaligned relative to the abutting surfaces T5 and T6 of the layout (a).

Furthermore, the abutting surface T13 of the layout (c) is aligned with the abutting surface T5 of the layout (a), while the abutting surface T14 of the layout (c) is displaced relative to the abutting surface T6 of the layout (a).

Therefore, when the layout (a) is used as a standard magnetic film layout, in the magnetic film layout (b), the abutting surfaces are displaced, while in the magnetic film layout (c), some of the abutting surfaces are aligned.

If the abutting surfaces of adjacent magnetic strip arrangements in the lamination direction are aligned in this manner, wrapping cannot be performed when the amorphous cores are integrated.

Therefore, the determination is shown on the right side of FIG. 6C, wherein the layout (b) is determined as "good", while the layout (c) is determined as "poor".

Next, a third embodiment of the present invention will be described, in which three magnetic strips having all different widths are used.

Figure 7A:
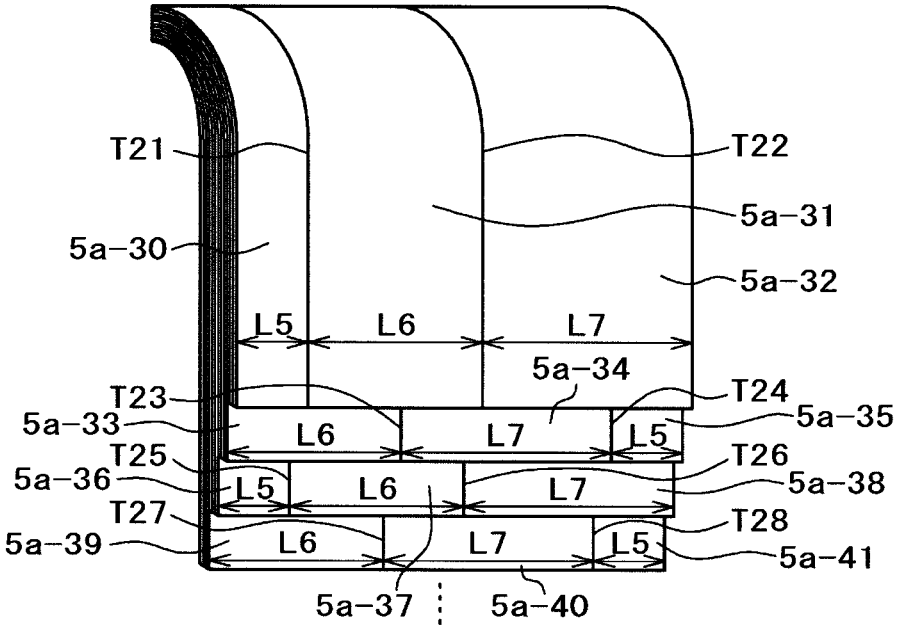
FIG. 7A is a partial perspective view showing the construction of an amorphous core according to a third embodiment of the present invention.

FIG. 7A shows an amorphous core according to the third embodiment of the present invention, in which the widths of the magnetic strips are set as L5, L6, and L7 and the relationship of L5<L6<L7 (hereinafter referred to as the small width L5, the medium width L6, and the large width L7) is established.

Referring to FIG. 7A, the amorphous core, from a fourth layer counting inwardly from its surface, will be described.

Firstly, as for the fourth layer counting inwardly from the surface, an amorphous core 5*a*-39 of the medium width L6 on the left side and an amorphous core 5*a*-40 of the large width L7 in the center abut against each other, and further, the amorphous core 5*a*-40 of the large width L7 in the center and an amorphous core 5*a*-41 of the small width L5 on the right side abut against each other to form the fourth layer amorphous core.

Subsequently, the amorphous core of the small width L5 on the right side is moved to the left side. Then an amorphous core 5*a*-36 of the small width L5 on the left side and an amorphous core 5*a*-37 of the medium width L6 in the center abut against each other, and further, the amorphous core 5*a*-37 of the medium width L6 in the center and an amorphous core 5*a*-38 of the large width L7 on the right side abut against each other to form a third layer on the fourth layer.

Subsequently, the amorphous core of the small width L5 on the left side is moved to the right side. Then an amorphous core 5*a*-33 of the medium width L6 on the left side and an amorphous core 5*a*-34 of the large width L7 in the center abut against each other, and further, the amorphous core 5*a*-34 of the large width L7 in the center and an amorphous core 5*a*-35 of the small width L5 on the right side abut against each other to form a second layer on the third layer.

Subsequently, the amorphous core of the small width L5 on the right side is moved to the left side. Then an amorphous core 5*a*-30 of the small width L5 on the left side and an amorphous core 5*a*-31 of the medium width L6 in the center abut against each other, and further, the amorphous core 5*a*-31 of the medium width L6 in the center and an amorphous core 5*a*-32 of the large width L7 on the right side abut against each other to form a surface layer on the second layer.

The above is an example of the arrangement of the three magnetic strips having different widths.

With regard to the arrangement of the three magnetic strips of different widths as shown in FIG. 7A, the positions of the abutting surfaces of each layer will be described.

Firstly, when comparing an abutting surface T27 between the amorphous cores 5*a*-39 and 5*a*-40 and an abutting surface T28 between the amorphous cores 5*a*-40 and 5*a*-41 of the fourth layer with an abutting surface T25 between the amorphous cores 5*a*-36 and 5*a*-37 and an abutting surface T26 between the amorphous cores 5*a*-37 and 5*a*-38 of the third layer laminated on the fourth layer, the abutting surfaces T27, T28, T25, and T26 are displaced with respect to one another in the lamination direction.

Next, when comparing the abutting surface T25 between the amorphous cores 5*a*-36 and 5*a*-37 and the abutting surface T26 between the amorphous cores 5*a*-37 and 5*a*-38 of the third layer with an abutting surface T23 between the amorphous cores 5*a*-33 and 5*a*-34 and an abutting surface T24 between the amorphous cores 5*a*-34 and 5*a*-35 of the second layer, the abutting surfaces T23, T24, T25, and T26 are displaced and misaligned relative to one another.

Next, when comparing the abutting surface T23 between the amorphous cores 5*a*-33 and 5*a*-34 and the abutting surface T24 between the amorphous cores 5*a*-34 and 5*a*-35 of the second layer with an abutting surface T21 between the amorphous cores 5*a*-30 and 5*a*-31 and an abutting surface T22 between the amorphous cores 5*a*-31 and 5*a*-32 of the surface layer, the abutting surfaces T23, T24, T21, and T22 are displaced and misaligned relative to one another.

Therefore, in the amorphous core shown in FIG. 7A, since the abutting surfaces of the layers are displaced and misaligned relative to one another, wrapping can be performed when the cores are integrated.

Next, various amorphous core construction patterns provided by changing the layout of the three amorphous magnetic strips of different widths will be described.

Figure 7B:
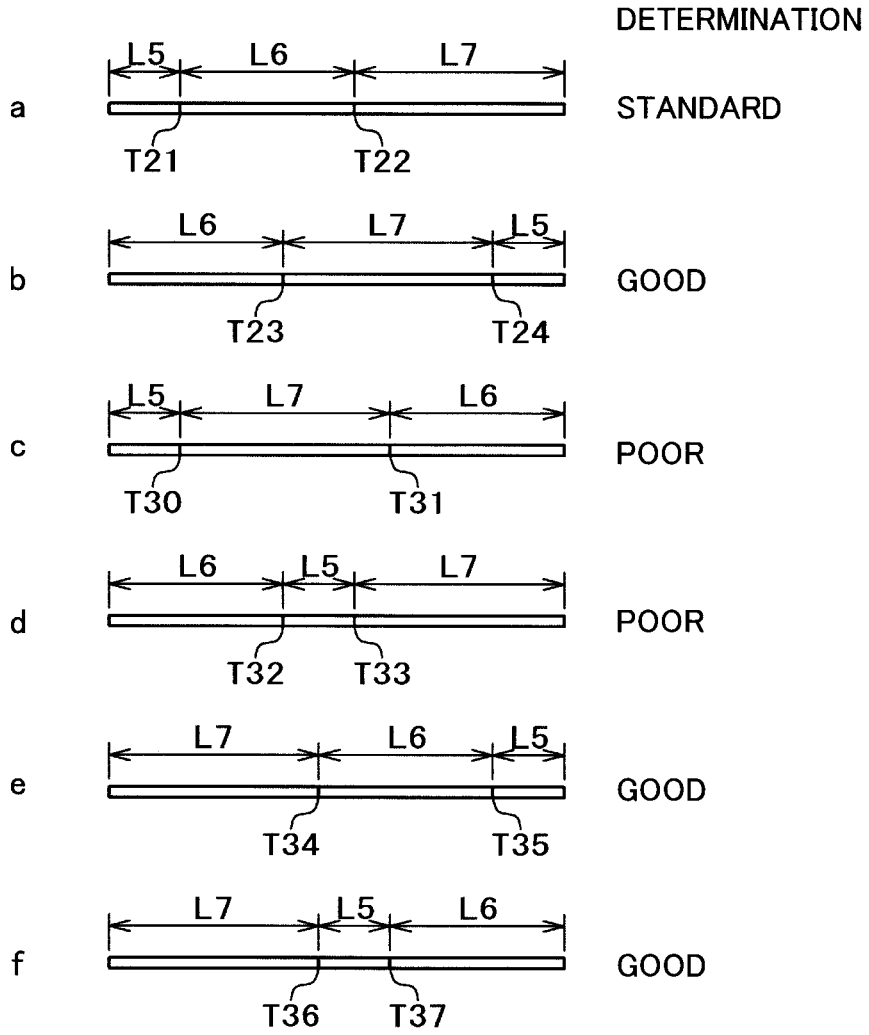
FIG. 7B is a view for explaining alternative constructions of FIG. 7A.
Figure 8:
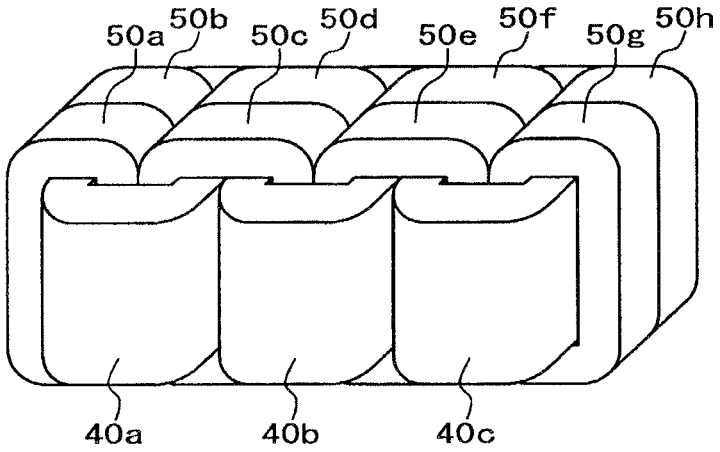
FIG. 8 Prior Art
FIG. 8 is a perspective view of a core coil assembly of an amorphous core transformer according to a related art.

In FIG. 7B, (a) shows a schematic view of the magnetic strip layout that is formed with an amorphous core of the small width L5 on the left side and an amorphous core of the medium width L6 in the center abutting against each other, and further, with the amorphous core of the medium width L6 in the center and an amorphous core of the large width L7 on the right side abutting against each other. The layout (a) is used as a standard for comparison of the abutting surfaces in the case of other amorphous core layouts. When the layout (a) is used as a standard, there are five patterns for the layout of the three amorphous magnetic strips. In layout (b), an amorphous core of the medium width L6 on the left side and an amorphous core of the large width L7 in the center abut against each other, and further, the amorphous core of the large width L7 in the center and an amorphous core of the small width L5 on the right side abut against each other to form the amorphous core.

In layout (c), an amorphous core of the narrow width L5 on the left side and an amorphous core of the large width L7 in the center abut against each other, and further, the amorphous core of the large width L7 in the center and an amorphous core of the medium width L6 on the right side abut against each other to form the amorphous core.

In layout (d), an amorphous core of the medium width L6 on the left side and an amorphous core of the small width L5 in the center abut against each other, and further, the amorphous core of the small width L5 in the center and an amorphous core of the large width L7 on the right side abut against each other to form the amorphous core.

In layout (e), an amorphous core of the large width L7 on the left side and an amorphous core of the medium width L6 in the center abut against each other, and further, the amorphous core of the medium width L6 in the center and an amorphous core of the small width L5 on the right side abut against each other to form the amorphous core.

In layout (f), an amorphous core of the large width L7 on the left side and an amorphous core of the small width L5 in the center abut against each other, and further, the amorphous core of the small width L5 in the center and an amorphous core of the medium width L6 on the right side abut against each other to form the amorphous core.

The above is the description of the amorphous core constructions (b) to (f) of FIG. 7B, that is, the magnetic strip layouts.

Next, the magnetic strip abutting surface positions of each of the constructions (b) to (f) will be described, as compared with the standard layout (a).

Firstly, a comparison of (b) with (a) indicates that the abutting surfaces T21, T22, T23, and T24 are displaced with respect to one another and there is no portion at which the abutting surfaces are aligned.

Therefore, by laminating adjacent layers with the alternating magnetic strip layouts (a) and (b), wrapping can be performed when the amorphous cores are integrated.

Next, a comparison of (c) with (a) indicates that an abutting surface T30 of (c) is aligned with the abutting surface T21 of (a), while an abutting surface T31 of (c) is displaced with respect to the abutting surface T22 of (a).

Therefore, since there is one portion where the abutting surfaces of (a) and (c) are aligned with each other, wrapping cannot be performed when the amorphous cores are integrated with adjacent layers laminated.

Next, a comparison of (d) with (a) indicates that an abutting surface T32 of (d) is displaced and misaligned relative to the abutting surface T21 of (a), while an abutting surface T33 of (d) is aligned with the abutting surface T22 of (a).

Therefore, when the amorphous cores are formed by alternately laminating the magnetic strip layouts (a) and (d), wrapping cannot be performed.

Next, a comparison of (e) with (a) indicates that abutting surfaces T34 and T35 of (e) are displaced and misaligned relative to the abutting surfaces T21 and T22 of (a).

Therefore, when the amorphous cores are formed and integrated by alternately laminating the magnetic strip layouts (a) and (e), wrapping can be performed.

Next, a comparison of (f) with (a) indicates that abutting surfaces T36 and T37 of (f) are displaced and misaligned relative to the abutting surfaces T21 and T22 of (a).

Therefore, when the amorphous cores are formed and integrated by alternately laminating the magnetic strip layouts (a) and (f), wrapping can be performed.

As can be seen, in the layouts (b), (e), and (f) as determined in FIG. 7B, when the magnetic strip layout (a) is used as a standard, the abutting surfaces of adjacent magnetic strips in the lamination direction are displaced and misaligned relative to each other. In this case, when the amorphous cores are assembled by alternately laminating the amorphous magnetic strips, the cores can be integrated and regarded as a single-piece core.

Also, with the constructions according to the foregoing embodiments of the present invention, a wider core than that of the related art can be provided.

What is claimed is:

1. An amorphous core transformer that stores a core coil assembly, the core coil assembly comprising:

an amorphous wound core which is formed by winding amorphous magnetic strips; and a coil that allows insertion of the amorphous wound core, wherein the amorphous wound core is constructed such that, when a plurality of blocks having different amorphous magnetic strip widths are arranged in abutting relation and laminated, the blocks having a first layer and a second layer disposed on the first layer in a radial direction of the amorphous wound core, and the first layer having first abutting surfaces which are arranged in a width direction of the amorphous wound core, and the second layer having second abutting surfaces which are arranged in a width direction of the amorphous wound core with a different order of the first layer, and the first abutting surfaces are displaced in a different position of the second abutting surfaces.

2. The amorphous core transformer according to claim 1, further comprising a bobbin installed in the coil, the bobbin being formed of a single hollow square pole for each coil.

3. An amorphous core transformer that stores a core coil assembly, the core coil assembly comprising:

an amorphous wound core which is formed by winding amorphous magnetic strips; and a coil into which the amorphous wound core is inserted, wherein the amorphous wound core is composed of a plurality of individual layers in a radial direction of the amorphous wound core, each individual layer is composed of at least two magnetic strips having different magnetic strip widths, and the plurality of layers have their magnetic strip widths staggered such that each magnetic strip width either immediately overlaps or is immediately overlapped by a magnetic strip width of a different size.

4. The amorphous core transformer according to claim 3, further comprising a bobbin installed in the coil, the bobbin being formed of a single hollow square pole for each coil.

* * * * *